US008016159B2

(12) United States Patent
Ma

(10) Patent No.: US 8,016,159 B2
(45) **Date of Patent: *Sep. 13, 2011**

(54) TWIST OPEN CLOSURE HAVING INCLINED FRANGIBLE MEMBRANE

(75) Inventor: Mike Xiaoli Ma, San Jose, CA (US)

(73) Assignee: Portola Packaging, Inc., Batavia, IL (US)

( * ) Notice: Subject to any disclaimer, the term of this patent is extended or adjusted under 35 U.S.C. 154(b) by 802 days.

This patent is subject to a terminal disclaimer.

(21) Appl. No.: 12/027,627

(22) Filed: Feb. 7, 2008

(65) Prior Publication Data

US 2008/0124432 A1 May 29, 2008

Related U.S. Application Data

(63) Continuation-in-part of application No. 10/525,143, filed as application No. PCT/US2004/030476 on Sep. 16, 2004, now Pat. No. 7,337,921.

(60) Provisional application No. 60/515,220, filed on Oct. 27, 2003.

(51) Int. Cl.
*B65D 1/24* (2006.01)
*B67D 3/00* (2006.01)

(52) U.S. Cl. ..... 222/83.5; 222/525; 222/541.2; 222/145.1; 220/529; 426/112

(58) Field of Classification Search ..... 206/219, 206/221, 222; 215/6, DIG. 8; 220/500, 506, 220/502, 529, 23.83, 258.1–258.5, 255.1; 222/81–83.5, 88, 525, 519–521, 541, 541.2, 548, 145.5, 219, 221, 145.1, 499; 426/120, 124, 112

See application file for complete search history.

(56) References Cited

U.S. PATENT DOCUMENTS

| | | | | |
|---|---|---|---|---|
| 4,221,291 | A | 9/1980 | Hunt | |
| 6,116,445 | A * | 9/2000 | Ikemori et al. | 215/301 |
| 2003/0000963 | A1 | 1/2003 | Julian | |
| 2003/0106911 | A1 | 6/2003 | Adams et al. | |
| 2006/0057257 | A1 | 3/2006 | Ma | |
| 2007/0045134 | A1 | 3/2007 | Dvorak et al. | |

* cited by examiner

*Primary Examiner* — Kevin P Shaver
*Assistant Examiner* — Melvin A Cartagena
(74) *Attorney, Agent, or Firm* — James Hanrath; Adam Sacharoff

(57) ABSTRACT

A closure for a container having an opening includes a base cap and an overcap that form a chamber adjacent the opening which is sealed from the contents of the container by a frangible membrane having an inclined line of weakness and by a hinge member having a pocket extending downward adjacent lower and upper terminuses of the line of weakness. The overcap includes a cutting member received within the pocket that severs the line of weakness upon substantial rotation of the overcap with respect to the base cap. A pushing member may cooperate with a cam member to deflect open the membrane upon severance. The pocket may include a stop for the cutting member. The base cap may include a cylindrical structure having an upwardly inwardly projection member to form a seal with an thickened upper portion of the overcap skirt to protect against penetration into the chamber.

44 Claims, 13 Drawing Sheets

TWIST OPEN CLOSURE HAVING INCLINED FRANGIBLE MEMBRANE

CROSS-REFERENCE TO RELATED APPLICATIONS

This application is a continuation in part of U.S. patent application Ser. No. 10/525,143 filed Feb. 16, 2005, which is a National Phase entry of PCT Application PCT/US04/30476 filed Sep. 16, 2004, which claims priority to U.S. Provisional Patent Application 60/515,220 filed Oct. 27, 2003.

BACKGROUND OF THE INVENTION

1. Field of the Invention

This invention relates, in general, to closures for containers and more particularly to twist-open closures having an inclined frangible membrane and methods for their use.

2. Description of Related Art

Closures designed to store a consumable separate from a liquid until use are known. For example, U.S. patent application Ser. No. 10/313,575 discloses a closure including a cap, a rotatable spout, piercing structure and a sealing foil that encases a consumable material such as a tablet. The piercing structure is adapted to pierce the sealing foil and bias the foil downwardly in order to facilitate the introduction of the tablet into the liquid of a container upon rotation of the spout relative to the cap.

While the above structure is quite effective to isolate the consumable material from the contents of the container until use, in some instances a discrete sealing foil may prove undesirable. An exemplar of a prior art closure, which does not require a discrete sealing foil, is International Application Publication No. WO 01/08996 to Yu, which publication shows a spin-opening type bottle cap for separating solute and solvent. Disadvantageously, such prior bottle caps may require a significant amount of force on the part of a user to initiate opening of the bottle cap. Furthermore, prior caps are often more complicated to manufacture. For example, as very precise alignment of parts is often necessary to assembly prior caps.

What is needed is a twist-open closure that overcomes the above and other disadvantages of known closures.

BRIEF SUMMARY OF THE INVENTION

In summary, one aspect of the present invention is directed to a closure for a container having an opening includes a base cap and an overcap that form a sealed chamber adjacent the opening, which chamber is isolated from the contents of the container. The base cap may include an outer skirt having container-engaging structure, a cylindrical well, a frangible membrane connected to the well along an inclined line of weakness and by a hinge member. The hinge member may include a pocket extending downward adjacent lower and upper terminuses of the line of weakness. The overcap may include a body having gripping structure, an inner skirt received within and rotatably connected to the well, and a cutting member depending from a lower end of the inner skirt received within the pocket such that the cutting member extends below the upper terminus. The cutting member preferably severs the line of weakness upon substantial rotation of the overcap with respect to the base cap.

The cutting member may be approximately one-eighth inch high. The cutting member may include an angled knife-edge. In one embodiment, relative rotation between the overcap and the base cap in excess of approximately 0-10 degrees causes the cutting member to at least partially sever the line of weakness. The container-engaging structure may include container-engaging thread dimensioned and configured to cooperate with closure-engaging thread of the container. The closure may further include a tamper-evidencing base band frangibly connected to a lower end of the outer base cap skirt. The closure may further include a tamper-evidencing overcap band frangibly connected to a lower end of the overcap body and operably engaging tamper-evidencing structure on the base cap. The overcap band may include an inwardly-extending protrusion extending inwardly and operably engaging an outwardly-extending protrusion on the base cap. In one embodiment, relative rotation between the overcap and the base cap in excess of approximately 0-5 degrees causes the overcap band to at least partially separate from the overcap body. A first amount of relative rotation between the overcap and the base cap may be required to at least partially separate the overcap band from the overcap body and a second amount of relative rotation may be required for the cutting member to at least partially sever the line of weakness in which the second amount may be greater than the first amount. The second amount may be approximately 2-10 degrees greater than the first amount.

The base cap may include an annular groove and the overcap may include a locking structure rotatably received within the groove to axially lock the overcap to the base cap. The inner overcap skirt may include a sealing bead extending around the lower end of the inner overcap skirt in which the sealing bead engages an inner surface of the well to provide a seal between the base cap and the overcap.

The overcap may include a pushing member having a lower end positioned adjacent the cutting member wherein the pushing member engages the membrane and pushes the membrane open upon substantial rotation of the overcap with respect to the cap base. The closure may further include a rotation lock that engages upon full rotation of the overcap with respect to the base cap. Full rotation may be in the range of approximately 300-330 degrees. Full rotation may be approximately 315 degrees. The rotation lock may include an outwardly-directed lock recess on the base cap and an inwardly-extending lock projection extending inwardly from an inner surface of the overcap body. The rotation lock may be configured to produce an audible sound upon engagement of the lock projection into the lock recess.

The well and the inner overcap skirt may form a sealed chamber and the closure further may include a consumable material in the chamber. The consumable material may be a tablet.

The overcap may include an aperture and the closure may include a dust cap having a plug for sealing the aperture. The dust cap may include a tamper-evidencing dust-cap band frangibly connected to a lower end of the dust cap and operably engaging tamper-evidencing structure on the base cap.

The twist-open closure of the present invention has other features and advantages which will be apparent from or are set forth in more detail in the accompanying drawings, which are incorporated in and form a part of this specification, and the following Detailed Description of the Invention, which together serve to explain the principles of the present invention.

DETAILED DESCRIPTION OF THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
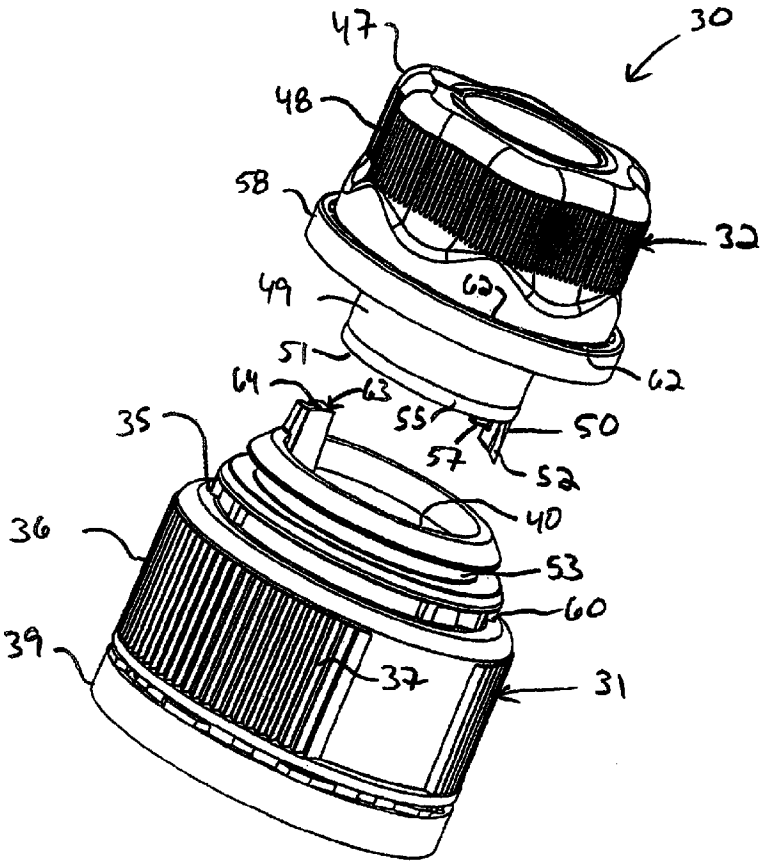
FIG. 1 is an exploded perspective side view of twist-open closure including a base cap and an overcap in accordance with the present invention.

A closure 30 in accordance with the present invention is shown in FIG. 1. The illustrated closure can be used with a container of the type often used for bottled water, sport drinks and other flowable bottled substances. The closure of the present invention is particularly suited for use with containers having a liquid that is to be mixed with a consumable including, but not limited to, tablets, powders and liquids by the consumer at the time of consumption. In some aspects, the closure is similar to that disclosed by U.S. patent application Ser. No. 10/313,575, the entire content of which is incorporated herein by this reference.

Figure 4:
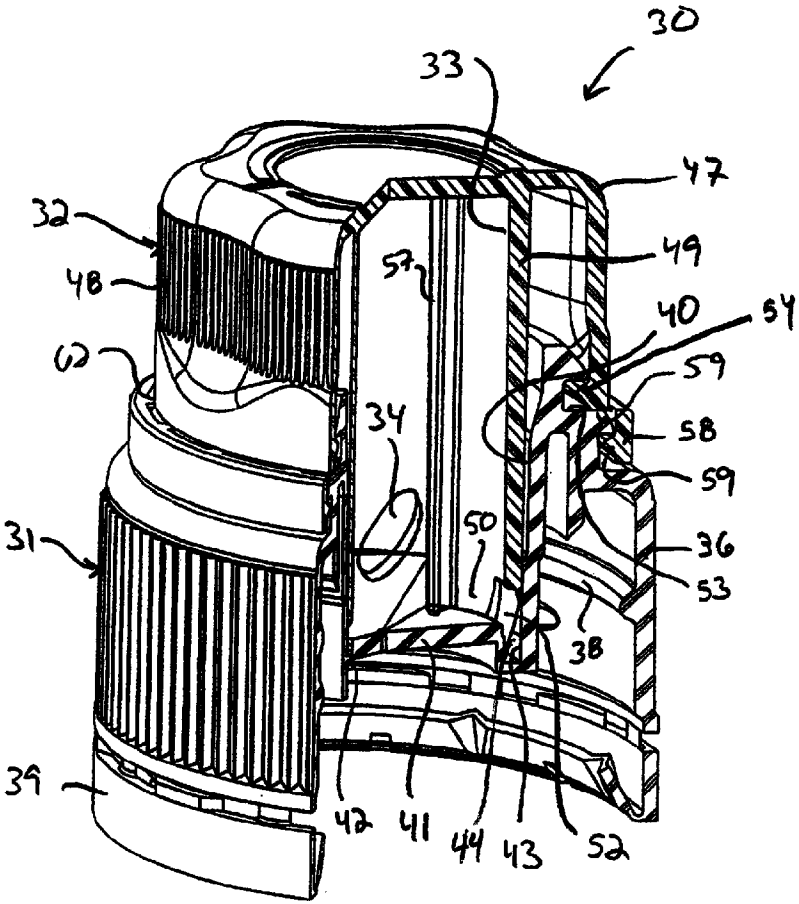
FIG. 4 is a partial cross-sectional perspective side view of the assembled closure of FIG. 1.

The closure of the present invention generally includes a cap base 31 adapted for releasably engaging the container and an overcap 32 rotatably mounted on the cap base to form a chamber 33 therebetween (see FIG. 4). The closure contains a consumable 34 (schematically illustrated as a tablet in FIG. 4) that may be mixed with, or otherwise introduced to the contents of the container to which closure is mounted when closure is initially opened.

Preferably, the cap base and the overcap are formed as monolithic thermoplastic members using various methods including, but not limited to, injection molding techniques well known in the art. The cap base and the overcap may be formed of various materials including, but not limited to, low-density polyethylene, linear low-density polyethylene, high-density polyethylene, polypropylene, polystyrene, and/or other suitable materials. Preferably the overcap is formed of a harder material than the cap base in order to facilitate cutting into the slanted membrane. For example, the overcap may be formed of a high-density polyethylene and the cap base may be formed of a low-density polyethylene.

In the illustrated embodiment, the cap base is generally dimensioned and configured to cooperate with a container having a tamper-evident neck finish of the type shown in U.S. Pat. No. 6,112,923 to Ma, the entire contents of which is incorporated herein by this reference. One should appreciate, however, that the cap base can be adapted to cooperate with other container neck finishes within the scope of the present invention. For example, a cap in accordance with the present invention can be adapted to cooperate with a container having a snap-on, screw-off cap neck finish of the type shown in U.S. Pat. No. 6,173,853 to Luch, the entire contents of which is incorporated herein by this reference. Alternatively, other cooperative closure-container retention structure, such as a simple snap engagement, can also be employed in accordance with the present invention.

The cap base includes a cap top 35. Although the annular surfaces of the cap top illustrated in FIG. 1 is planar, the cap top can alternatively have a frustoconical or other suitable shape. A base-cap outer skirt 36 depends downwardly from the cap top in a well-known manner. The base cap outer skirt includes vertically extending ribs 37 extending from an external surface thereof to provide a gripping surface for facilitating a user in gripping and turning the cap base to screw the closure on and off from a respective container. The cap skirt also includes a container-engaging member extending from an internal surface of the cap skirt. In the illustrated embodiment, the container-engaging member includes internal threads 38. As noted above, the cap can be adapted for use with various container-neck finishes, in which case a different thread or snap fit configuration can be used. Preferably, a tamper-evident base band 39 is frangibly connected to a bottom portion of the cap skirt and is adapted to detachably engage the container in a well known manner, as described in the '923 Ma patent.

The base cap also includes a cylindrical well 40 and a frangible membrane 41 connected to and fluidly sealing the bottom of the well, as can be seen in FIG. 4. The membrane is connected to the well along an inclined line of weakness 42 and by a thickened-material hinge member 43 such that the membrane remains attached to the well by the hinge member even after the line of weakness has been separated, as described below. In one embodiment, the hinge member includes a pocket 44 that extends downwardly adjacent the lower terminus 45 and the upper terminus 46 of the line of weakness.

The overcap includes an overcap body 47 having gripping structure 48, and an inner skirt 49 received within and in rotatable contact with the well. The overcap further includes a cutting-member 50 depending from a lower end 51 of the inner skirt received within the pocket such that the cutting member extends below the upper terminus and adjacent the lower terminus of the line of weakness. Preferably, the cutting member also extends into the pocket to a level that is slightly below the lower terminus in order to ensure that the cutting member severs the line of weakness and thus severs the connection between the frangible membrane and the well.

Figure 3:
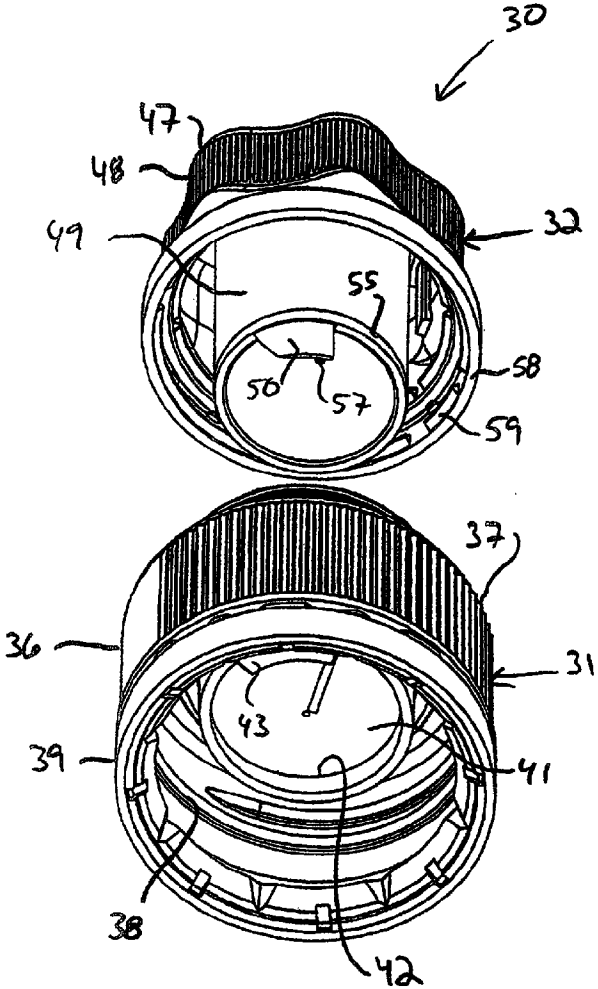
FIG. 3 is an exploded perspective bottom view of the closure of FIG. 1 similar to that shown in FIG. 2 but rotated approximately 90.degree.
Figure 6:
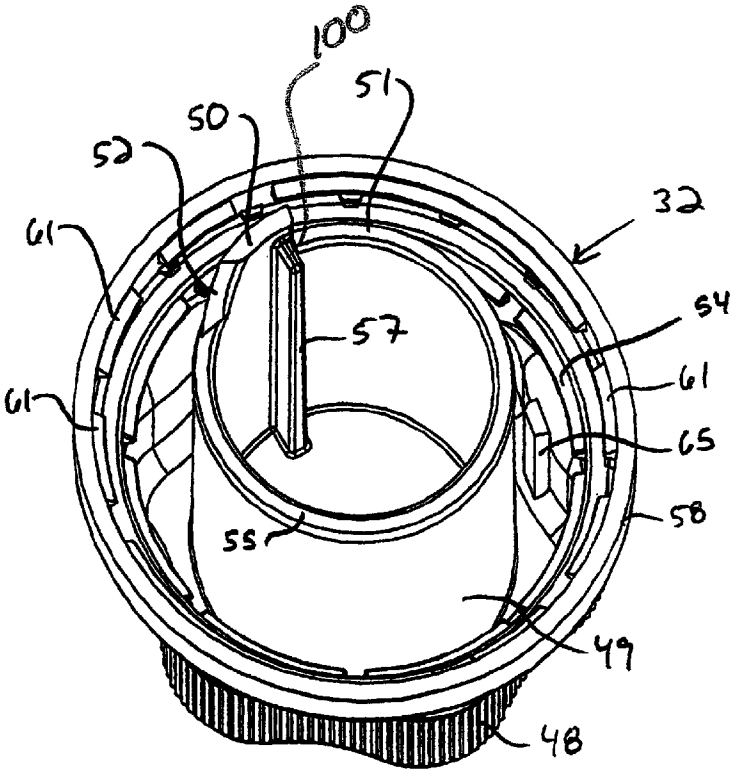
FIG. 6 is a perspective bottom view of the overcap of FIG. 1.
Figure 5:
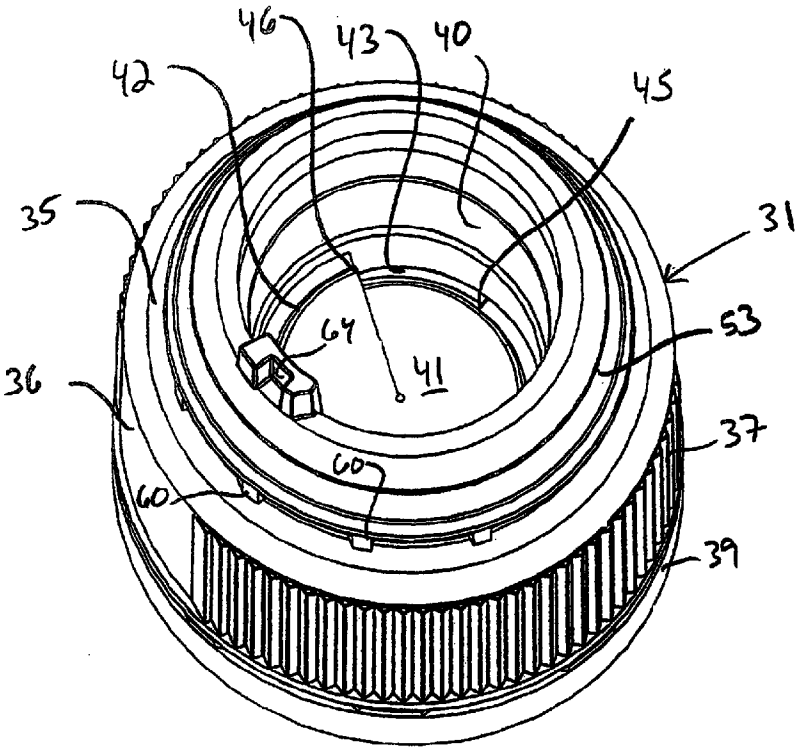
FIG. 5 is a perspective top view of the base cap of FIG. 1.

The line of weakness extends along a helical path thus providing the frangible membrane with a slanted or inclined configuration, as can be seen in FIG. 3 and FIG. 4. Such a slanted-membrane configuration allows the cutting member to gradually cut into the line of weakness thus reducing the amount of twisting force necessary for a user to initiate cutting.

Preferably, the cutting member is approximately one-sixteenth to one-half inches high, and most preferably, approximately one-eighth inch high. One will appreciate that the actual height of the cutting member will vary depending upon the dimensions of the frangible membrane. In this regard, the cutting member is preferably slightly taller than the vertical distance between lower and upper termini of the line of weakness. The cutting member may include an angled knife-edge 52 in order to facilitate cutting along the line of weakness.

In one embodiment, the base cap includes an annular groove 53 and the overcap includes locking structure such as, but not limited to, a locking bead 54 rotatably received within the groove to axially lock the overcap to the base cap. Preferably, the inner overcap skirt includes a sealing bead 55 extending around the lower end of the inner overcap skirt and engages an inner surface 56 of the well in order to provide an effective seal between the base cap and the overcap. Such configuration facilitates isolation of the consumable or like item from the liquid or other contents of the container. One will appreciate that the seal may be fluid-tight, airtight and/or other suitable seal designed according to the package requirements. For example, the seal may be configured to provide an airtight seal if required to protect ingredients contained within the chamber from atmospheric moisture, air, oxygen or other ambient environment.

Figure 17:
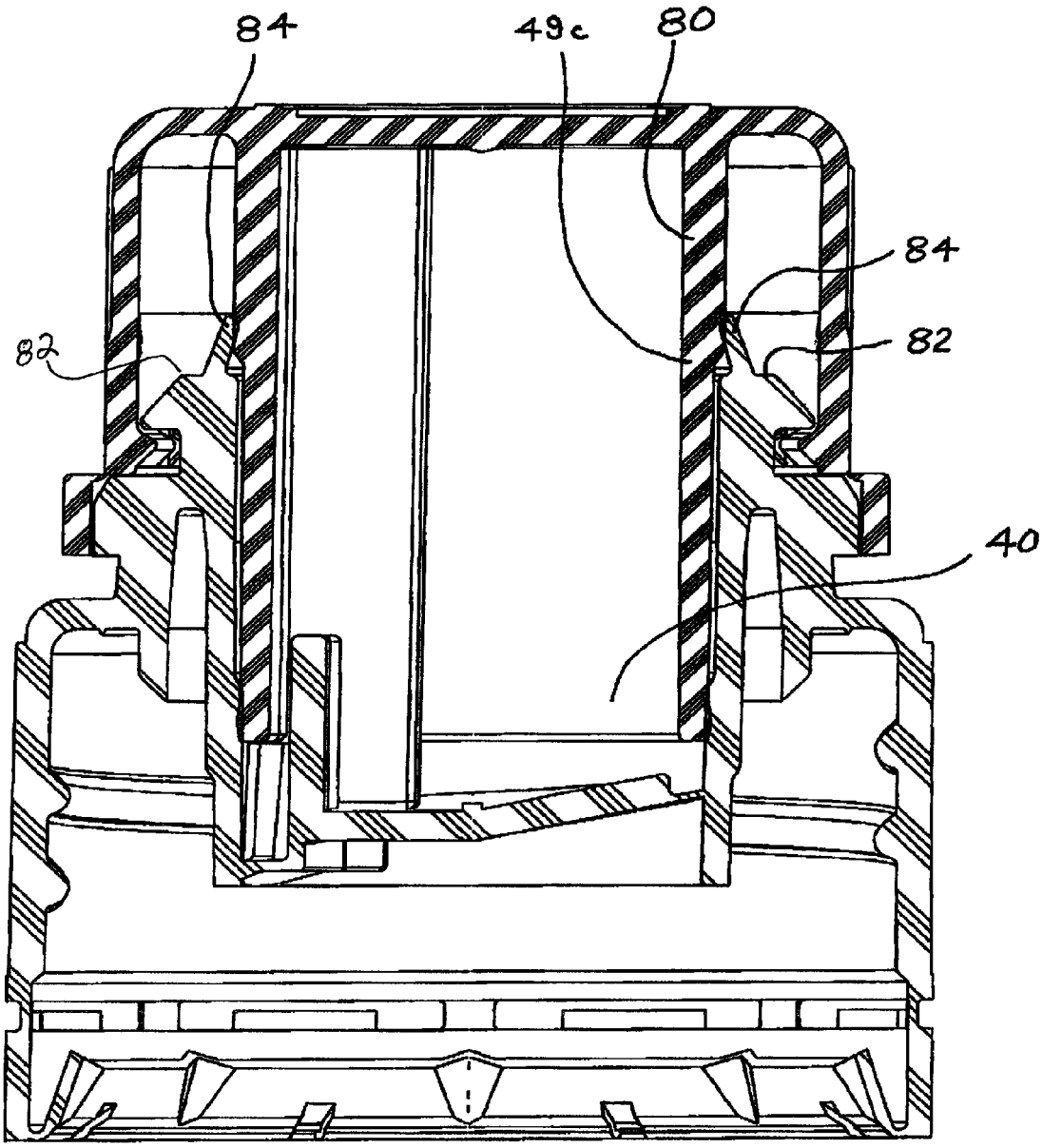
FIG. 17 is a sectional view of an assembled closure showing another embodiment of the invention.

Referring now to FIG. 17, there is shown an embodiment offering increased seal security for the contents of the well prior to initial activation of the closure system to sever the frangible membrane connected to the well. In the embodiment of FIG. 17, an upper portion 80 of the inner skirt 49*c* is thickened slightly to define an increased outside diameter, as shown, in comparison to the lower portion of the inner skirt. In addition, an upwardly-inwardly directed projection 84 extends from an upper surface 82 of the cylindrical structure defining well 40 to the increased outside diameter. The minimum diameter defined by projection 84 is slightly less, and therefore is in slight interference with the outside diameter of upper portion 80. The increased outer diameter of the thickened upper portion 80 of the inner skirt 49*c* thus forms a seal with the minimum diameter of the cylindrical structure projection 84. This arrangement effectively forms an additional seal against environmental penetration into the well and its contents prior to initial activation of the closure system to sever the frangible membrane connected to the well.

Figure 2:
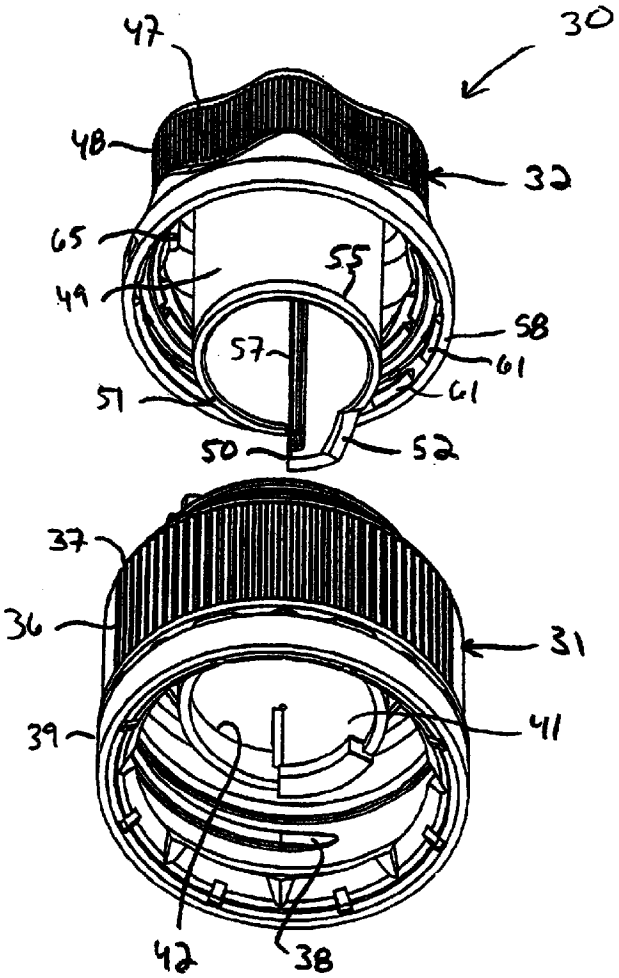
FIG. 2 is an exploded perspective bottom view of the closure of FIG. 1.

Turning now to FIG. 2 and FIG. 4, the pocket of the hinge member extends in an arcuate manner along the peripheral edge of the frangible membrane. The pocket may extend approximately 5-180 degrees, preferably approximately 5-90 degrees, and more preferably approximately 30-60 degrees along the peripheral edge of the frangible membrane. In the illustrated embodiment, extends approximately 45 degrees. Such a circumferentially-extending configuration allows a certain amount of relative rotation between the overcap and the base cap before the cutting member cuts into the frangible membrane along the line of weakness. For example, in one embodiment, the relative rotation between the overcap and the base cap must exceed approximately 0-10 degrees to cause the cutting member to at least partially sever the line of weakness.

Figure 8:
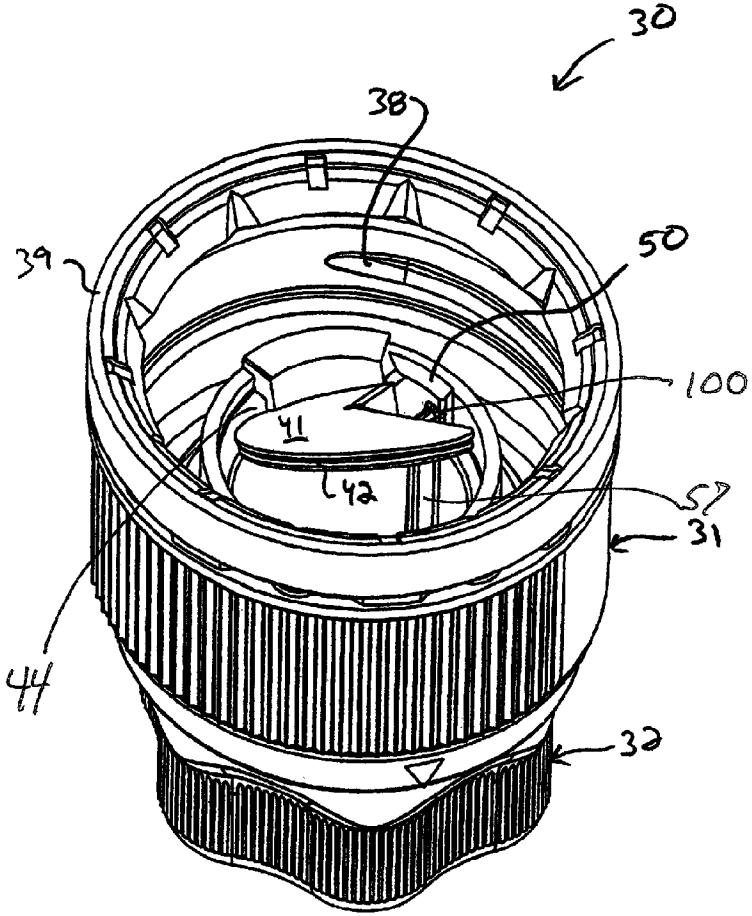
FIG. 8 is a perspective bottom view of the assembled closure of FIG. 1 showing an opened frangible membrane of the base cap.
Figure 7:
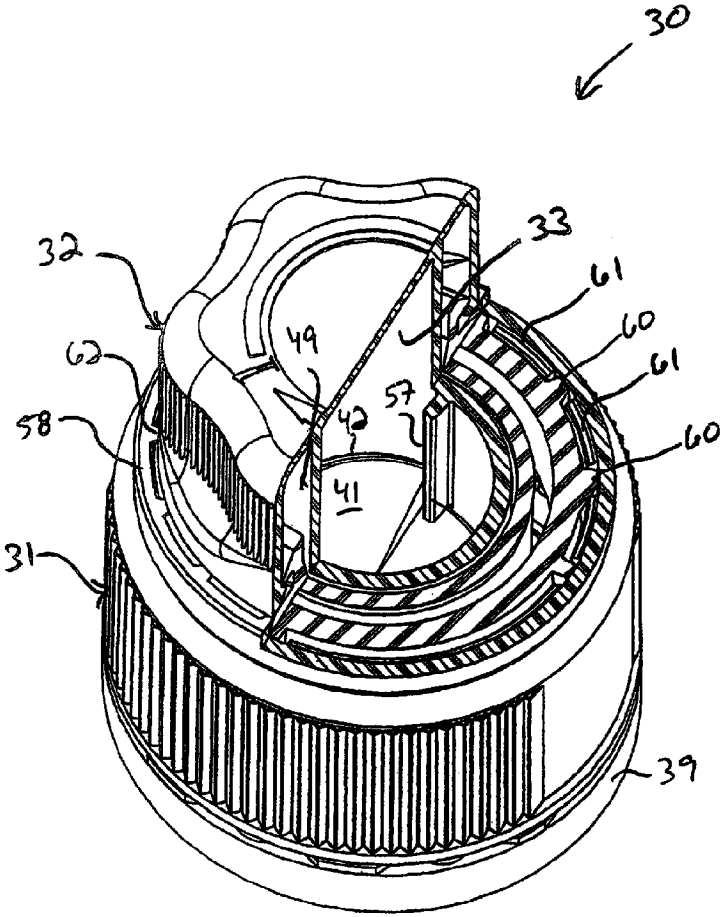
FIG. 7 is a partial cross-sectional perspective top view of the assembled closure of FIG. 1.
Figure 10:
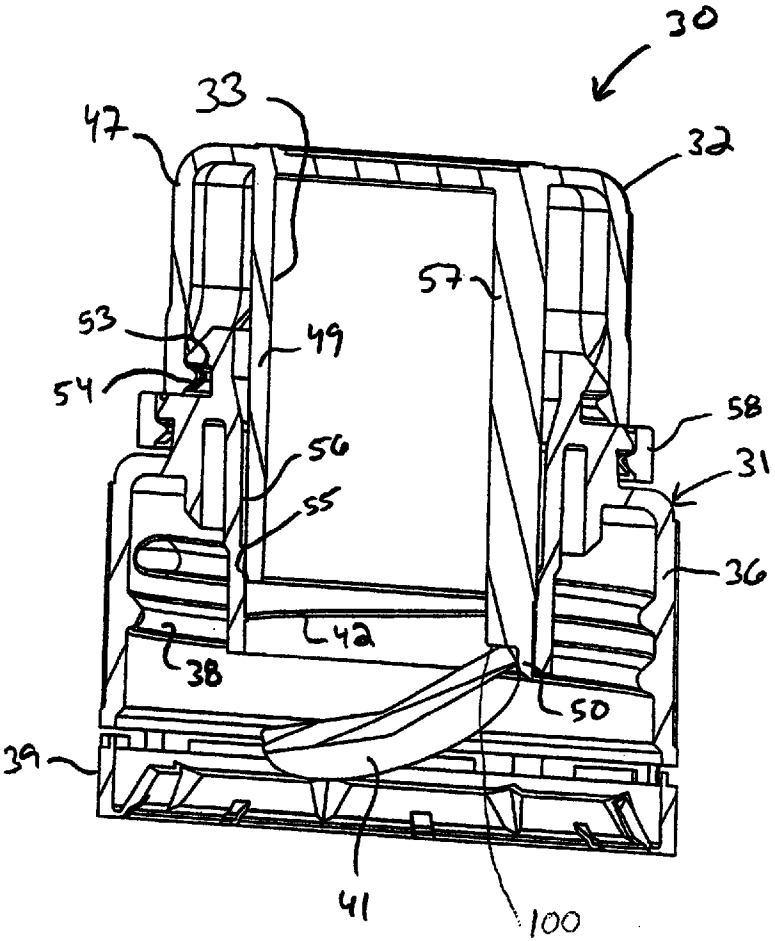
FIG. 10 is a cross-sectional side perspective side view of the assembled closure of FIG. 1 taken along line 10-10 of FIG. 9.
Figure 9:
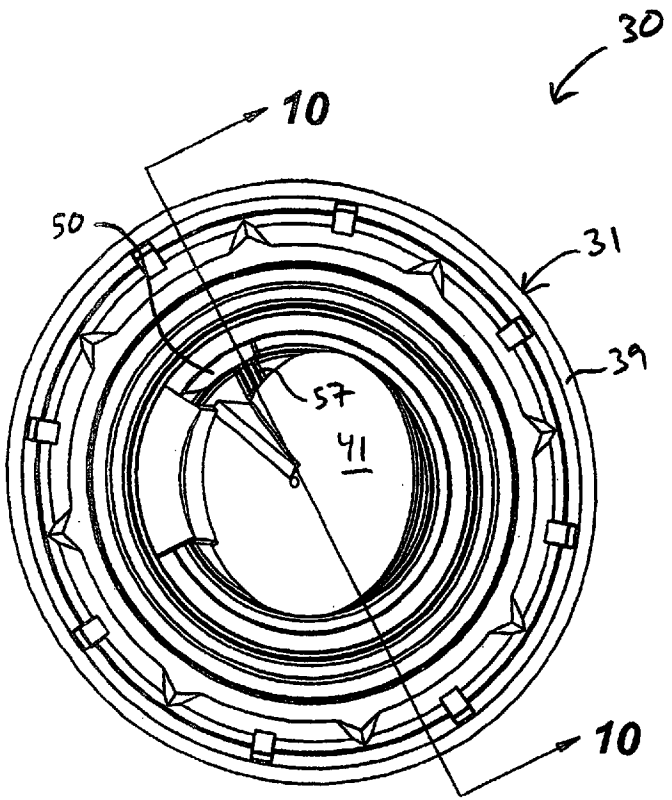
FIG. 9 is a bottom view of the closure of FIG. 1 showing the opened frangible membrane.
Figure 12:
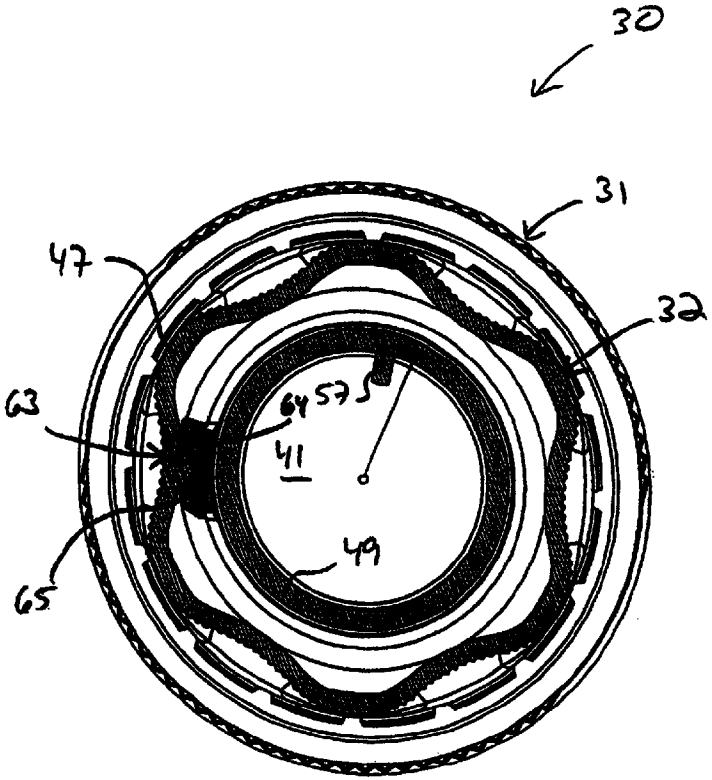
FIG. 12 is a cross-sectional top view of the assembled closure of FIG. 1 taken along line 12-12 of FIG. 11.
Figure 11:
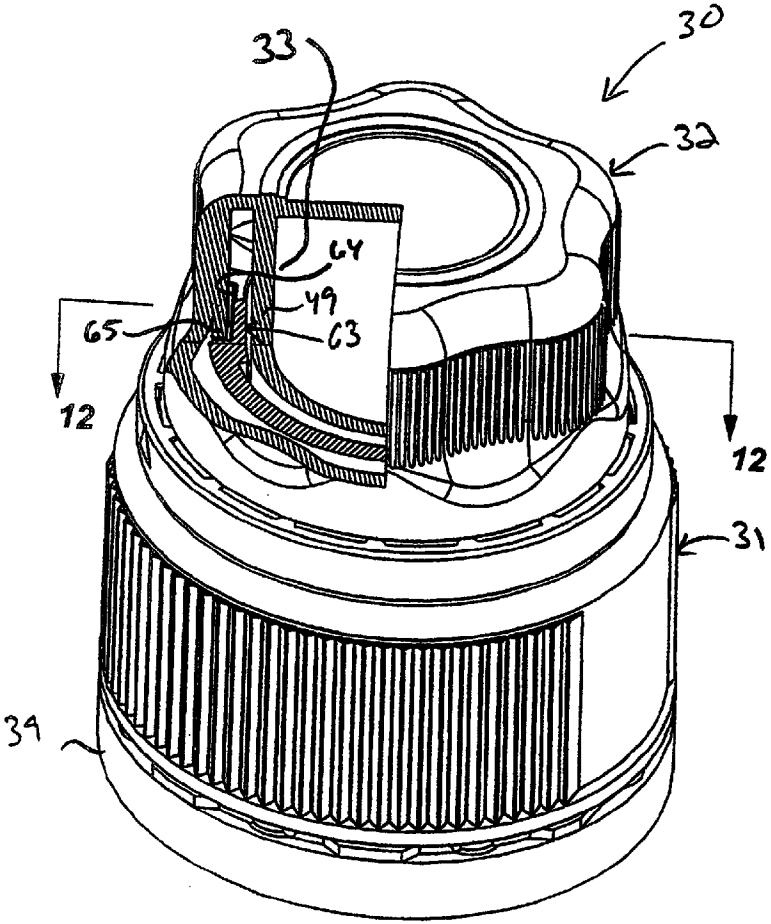
FIG. 11 is a partial cross-sectional perspective top view of the assembled closure of FIG. 1.
Figure 14:
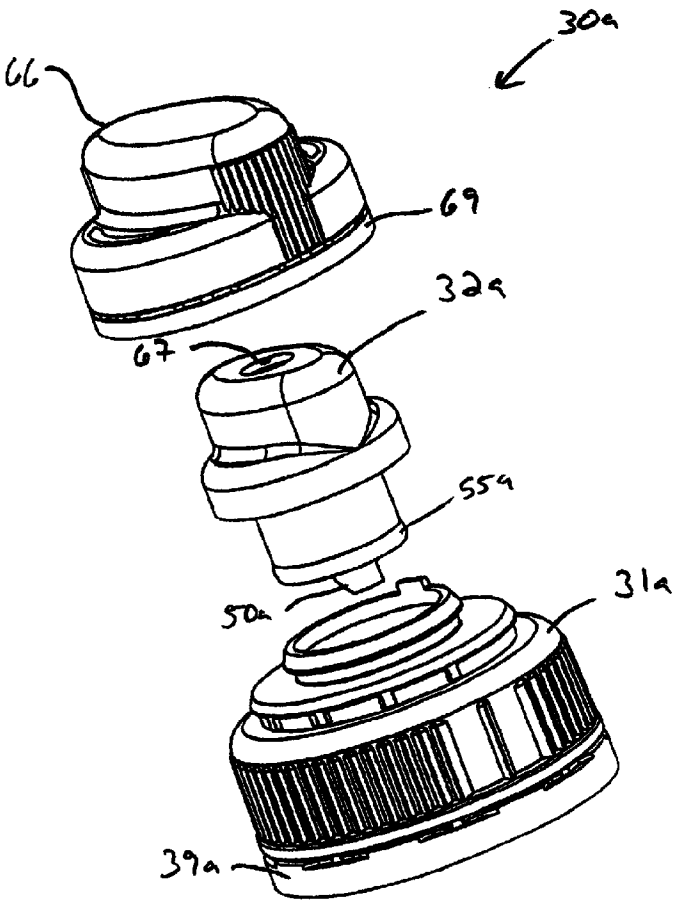
FIG. 14 is an exploded perspective side view of the closure of FIG. 13.
Figure 13:
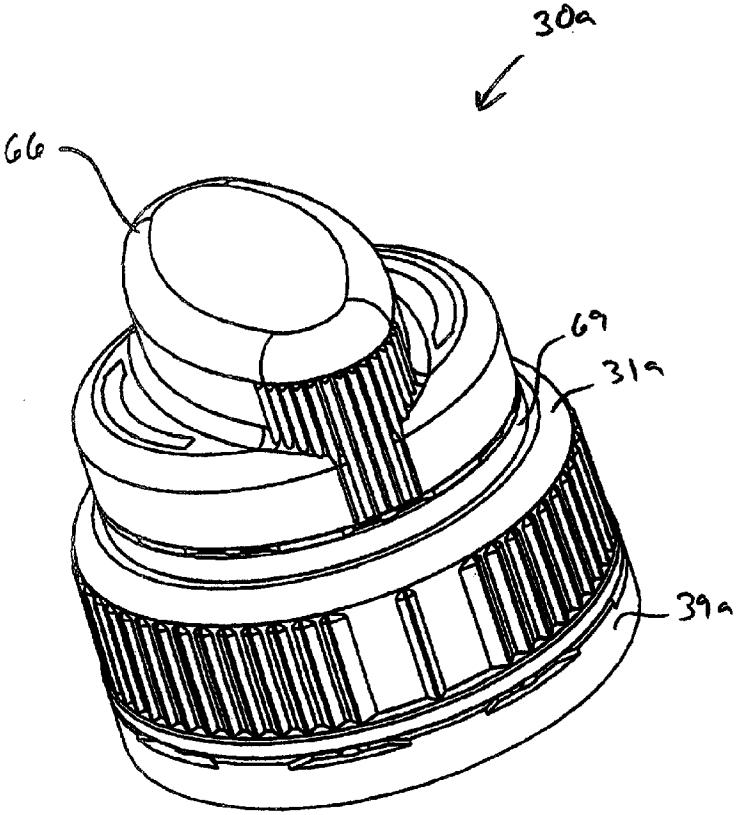
FIG. 13 is an assembled perspective side view of another twist-open closure including a base cap, an overcap and a dust cap in accordance with the present invention.
Figure 16:
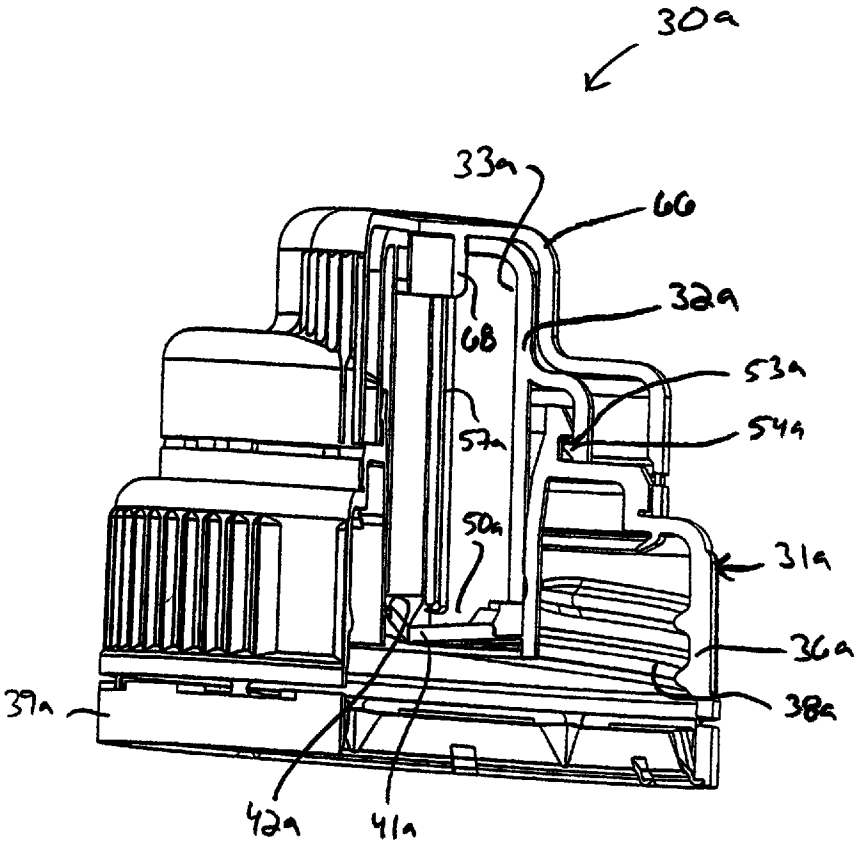
FIG. 16 is a partial cross-sectional perspective side view of the assembled closure of FIG. 13.
Figure 15:
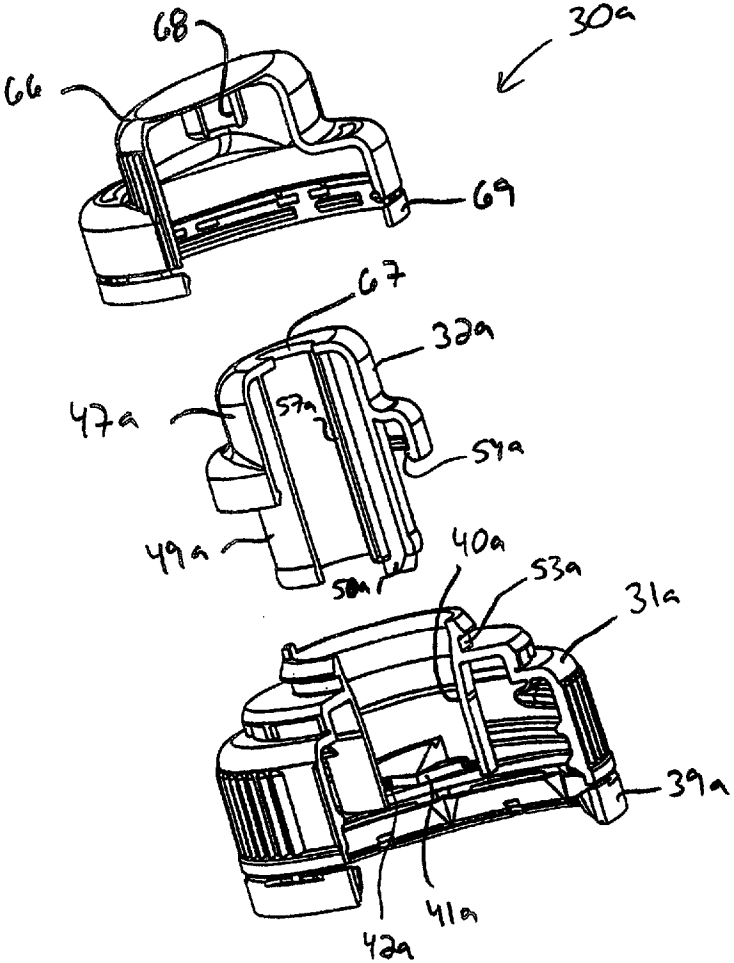
FIG. 15 is a partial cross-sectional exploded perspective side view of the closure of FIG. 13.

As a user continues to rotate the overcap, the cutting member continues to cut along the line of weakness thus opening the chamber defined by the well to the interior and/or contents of the container to which the closure is mounted. In one embodiment, the overcap includes a pushing member 57 having a lower end 100 positioned adjacent the cutting member. As the cutting member approaches its substantially complete rotational movement, the lower end 100 of pushing member 57 engages the membrane and pushes the membrane open upon substantial rotation of the overcap with respect to the cap base, as shown in FIG. 7 and FIG. 8. In this regard, the pushing member follows the cutting member along the periphery of the membrane from the lower terminus to the upper terminus, eventually contacting the membrane and biasing the membrane downwardly as shown in FIG. 10. For the purpose of the present invention, substantial rotation refers to the amount of rotation required for the cutting member to sever a sufficient portion of the line of weakness to allow the frangible membrane to fold or otherwise displace downwardly allowing a consumable or other item located within the well to fall downwardly into the interior and/or contents of the container.

Figure 18:
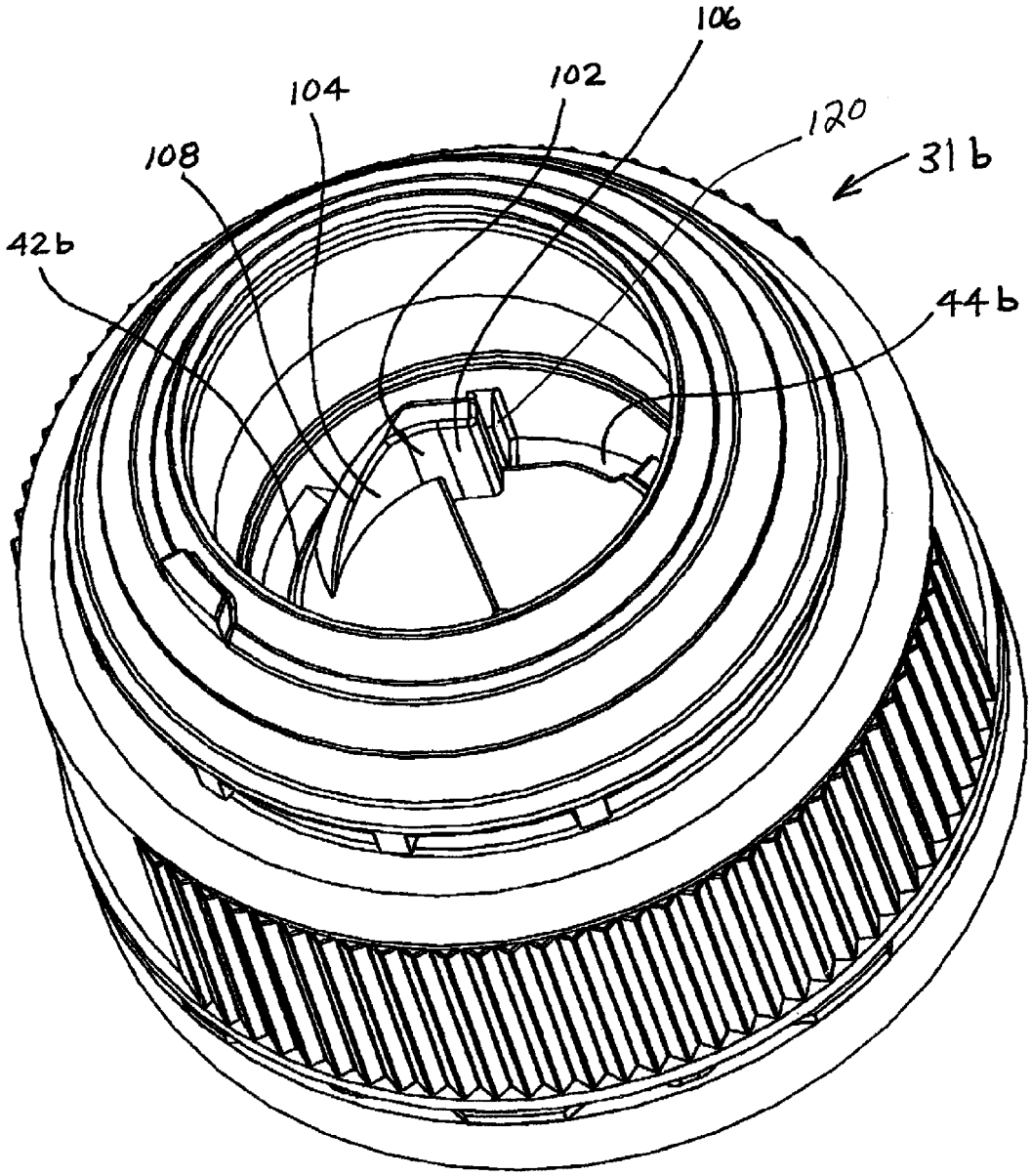
FIG. 18 is perspective view from the top of a base cap of a closure embodying additional structural features of the invention.
Figure 19:
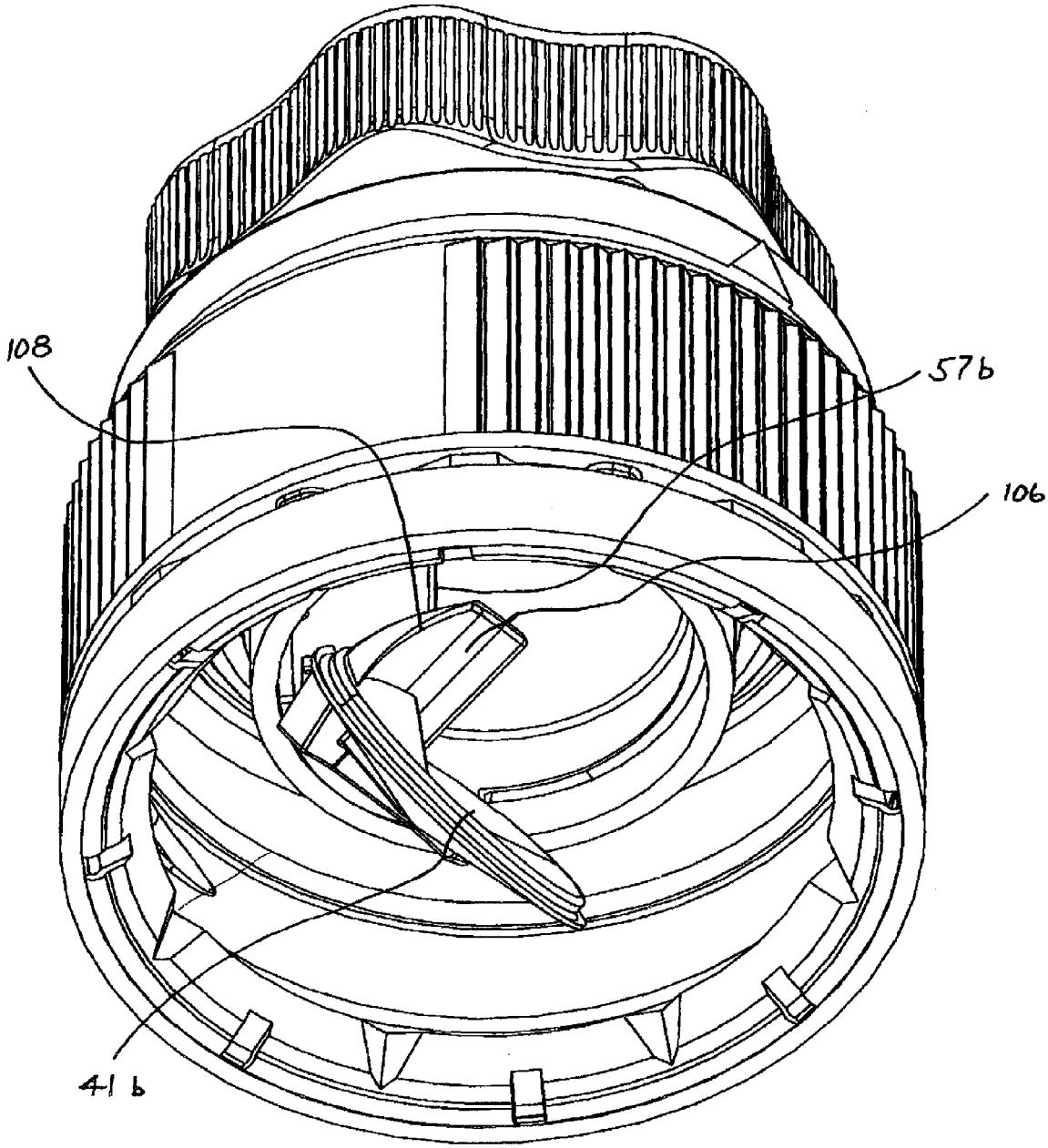
FIG. 19 is a perspective view from the bottom of an assembled closure inclusive of the base cap of FIG. 18 showing the condition wherein the cutting member has been fully rotated and the frangible membrane severed.

With continued reference to FIGS. 7-10, one can appreciate that the amount of linear, vertical interference between of the lower end 100 of pushing member 57 and the membrane 41 is limited by the difference in the vertical heights between the lower and upper termini 45 and 46 respectively of line of weakness 42. In some environments of use this limited interference might be insufficient to ensure enough deflection of membrane 41 to allow thorough delivery of the variable content of well 40 to the container. The embodiments of FIGS. 8 and 19 address this problem. FIG. 18 shows a top perspective view of a base cap 31*b* having an additional cam structure 102 to increase the membrane displacement following the cutting of membrane 41*b*. Cam structure 102 is in the form of a projection joined to the membrane adjacent the pocket 44 that extends upwardly in the axial direction and between the termini of line of weakness 42*b*. Cam structure 102 comprises a ramp portion 104 connected to a wall portion 106. Ramp portion 104 has free edge 108 which extends upwardly at an angle to the horizontal which is greater than that defined by the inclination of line of weakness 42*b*. Wall portion 106 has oppositely facing surfaces, namely an inwardly directed face as more easily observed at FIGS. 8 and 19 and an outwardly directed face as more easily observed at FIG. 21.

The cam structure 102 interacts with the pushing member 57*b* as follows. Upon initial relative rotation of the overcap with respect to the base cap, cutting member 50*b* initiates cutting of line of weakness 42*b* as in prior embodiments. Eventually upon continued rotation the lower end 100*b* of pushing member 57*b* contacts membrane 41*b* and promotes deflection of membrane 41*b* downward and away from its original position. With continued rotation the lower end 100*b* of pushing member 57*b* eventually contacts the free edge 108 of ramp portion 104 and its associated increased inclination relative to the line of weakness 42*b*. The interference of the pushing member with the ramp portion forces increased deflection of the membrane from its original position when compared to the situation of FIGS. 7-10. As rotation of the overcap relative to the base cap nears completion, the deflection of the membrane and attached cam structure becomes sufficient to permit the lower end 100*b* of pushing member 57*b* to deflect slightly to an arrangement shown in FIG. 19 wherein the lower end 100*b* contacts the originally outward facing surface of wall portion 106 and thereby hold the membrane in a positively secured position of satisfactory deflection.

In one embodiment, the overcap includes a tamper-evidencing overcap band 58 that is frangibly connected to a lower end 59 of the overcap body. The overcap band is dimensioned and configured to operably engage a tamper-evidencing structure 60 on the base cap. In one embodiment, the overcap band includes an inwardly-extending protrusion such as, but not limited to, the illustrated segmented bead 61 that operably engages the tamper-evidencing structure of the base cap. The inwardly-extending protrusion and the base-cap tamper-evidencing structure cooperate to prevent rotation of the overcap with respect to the base cap without breaking one or more overcap bridges 62 that frangibly connect the overcap band to the overcap body. Preferably, the tamper-evidencing structure includes one or more outwardly-extending protrusions, however, one will appreciate that other tamper-evidencing configurations may be utilized in accordance with the present invention including, but not limited to splines, ratchet teeth, and/or other suitable anti-rotation means. The overcap bridges are configured to fail upon relative rotation between the overcap and the base cap.

In one embodiment, relative rotation between the overcap and the base cap exceeding approximately 0-5 degrees causes the overcap band to at least partially separate from the overcap body, however, one will appreciate that the actual amount of rotation may vary in accordance with the present invention. Preferably, a first amount of relative rotation between the overcap and the base cap required to initiate separation of the overcap band from the overcap body is less than the relative rotation that is required for the cutting member to initiate severance of the line of weakness. In particular, as a user twists the overcap relative to the cap base, the frangible bridges will fail before the cutting member initiates cutting of the frangible membrane thus providing a visual indication that someone may have tampered with the closure, and the container upon which it is mounted, even before the frangible membrane is damaged. In one embodiment, second amount is approximately 2-10 degrees greater than the first amount, which is substantially equal to the angular distance between the knife-edge and the lower terminus.

In one embodiment, the closure further includes a rotation lock or stop 63 that engages upon full rotation of the overcap with respect to the base cap. Preferably, full rotation is greater than approximately 180 degrees, more preferably within the range of approximately 300-330 degrees, and most preferably approximately 315 degrees. The rotation lock or stop is required to prevent the consumer from continued rotation and causing the pushing member to be rotated past the point wherein it is forcing downward deflection of the membrane. In the embodiment of FIGS. 1-12, the rotation lock includes an outwardly-directed lock recess 64 on the base cap and an inwardly-extending lock projection 65 extending inwardly from an inner surface of the overcap body. This form of rotation lock may be configured to produce an audible sound upon engagement of the lock projection into the lock recess. This form of rotation lock also discourages and/or prevents reverse relative rotation of the overcap with respect to the cap base thus ensuring that the pushing member prevents the frangible membrane from returning to its initial position. In use, the consumer may continue rotating the overcap to the point of full rotation thereby activating the rotation lock. Namely, once full rotation is accomplished, the lock projection snaps into the lock recess thus providing the user with an audible click and tactile feel indicating that the closure chamber is fully opened.

Figure 20:
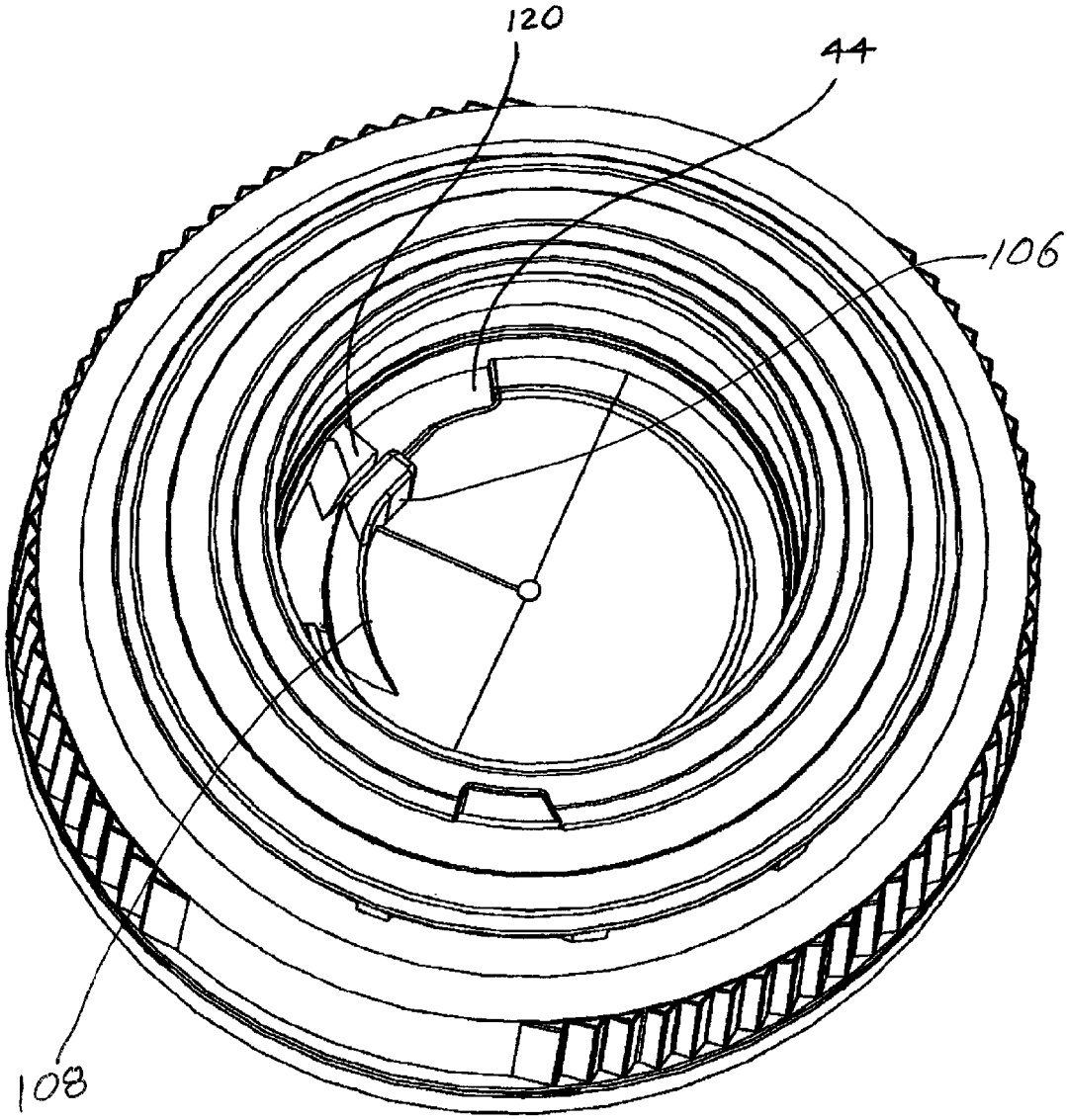
FIG. 20 is a perspective view from the top of a base cap of a closure embodying structural features of the invention.
Figure 21:
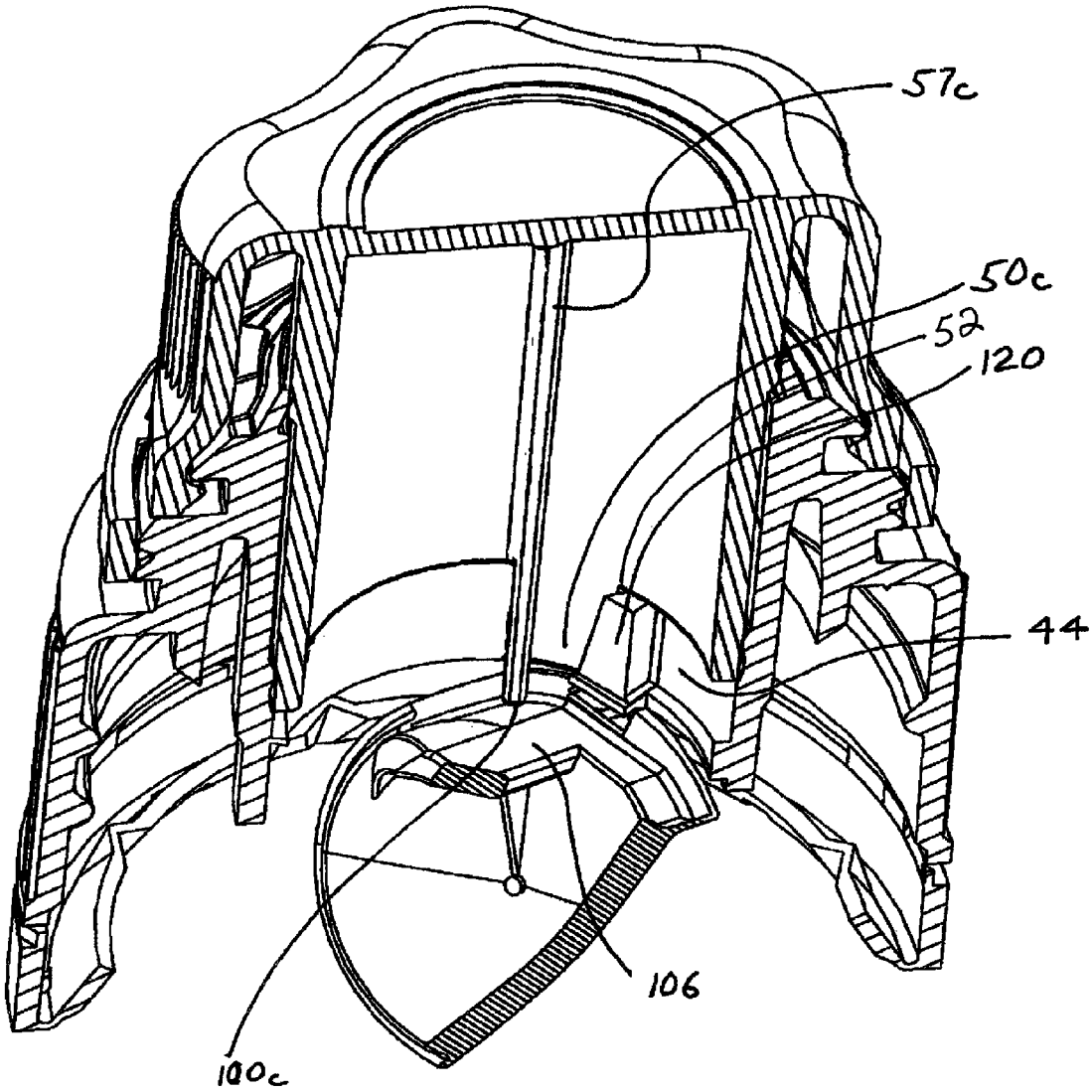
FIG. 21 is a partial cross-sectional perspective view of an assembled closure inclusive of the base cap of FIG. 20 embodying structural features of the invention.

Another form of rotation stop is depicted in FIGS. 20 and 21. In this embodiment a rib 120 projects upward from the bottom of the knife pocket 44. The rib is positioned approximately midway of the arcuate extent of the pocket. As initially assembled and before activation of the closure system to sever the frangible membrane connected to the well, the knife or cutting member resides in the pocket region to one side of the rib projection 120. Upon completion of the activating rotation to sever the frangible membrane, the knife has traveled to the opposite side of the projection and into abutting position with the projection. As best shown in the FIG. 21 embodiment, the angle on the leading or cutting face 52 of the cutting member 50*c* may be complimentary inclined or shaped to the abutting surface of the stop projection 120. Thus the rib 120 acts as a stop to prevent further relative rotation of the base and overcap.

The stop feature 120 of the embodiment of FIGS. 20 and 21 has the advantage of preventing the consumer from turning the wrong direction on initial closure severance activation as well as being a very positive abutment which is difficult to override. The advantage of the retention lock or stop featuring lock recess 64 and lock projection 65 depicted in FIGS. 1-12 is an audible and tactile "click" indicating complete rotation has occurred. One will appreciate that the retention lock or stop features of FIGS. 1-12 may be used in combination with the stop feature 120 of FIGS. 20 and 21.

The method of using the closure in accordance with the present invention can now be described. Closure 30 may be assembled prior to its application onto a container. In particular, the well of the base cap and/or the cylindrical skirt of the overcap may be provided with a consumable item. The base cap and overcap are then assembled by inserting the cylindrical skirt into the well such that the consumable item is located in the chamber formed between the cylindrical skirt and the well. The chamber is sealed from exterior of the closure and thus is also isolated from the contents of the container upon which the closure is mounted.

In operation and use, a user will hold the container and twist the overcap relative to the base cap and the container. Upon a first amount of relative rotation, the connecting bridges of the overcap band fail thus providing visual indication of tampering. With continued rotation of the overcap relative to the base cap, the cutting member begins to cut into and along the line of weakness thus partially separating the frangible membrane from the well and exposing the chamber, and the consumable therein, with the interior and contents of the container. Continued rotation of the overcap causes the pushing member to bias the membrane downwardly thus facilitating the introduction of the-consumable item into the contents of the container. The user may continue rotating the overcap to the point of full rotation thereby activating the rotation lock. Namely, once full rotation is accomplished, the lock projection snaps into the lock recess thus providing the user with an audible click indicating that the closure chamber is fully opened. The configuration of the rotation lock discourages and/or prevents reverse relative rotation of the overcap with respect to the cap base thus ensuring that the pushing member prevents the frangible membrane from returning to its initial position.

Advantageously, the slanted-membrane configuration of the present invention allows for a closure that is relatively simple to manufacture. The overcap may simply be aligned and snapped onto the base cap without twisting. Also, the configuration of the present invention also provides for a compact design. As the closure does not require axial motion to pierce the membrane, the closure may have smaller axial dimensions and/or a lower profile.

In another embodiment of the present invention, closure 30*a* is similar to closure 30 described above but includes a dust cap 66 as shown in FIG. 13 through FIG. 16. Like reference numerals have been used to describe like components of closure 30 and closure 30*a*. In this embodiment, the overcap includes an aperture 67 which allows dispensing of the container contents once the frangible membrane has been opened. The dust cap including a plug 68 for sealing the aperture.

Preferably, the dust cap includes a tamper-evidencing dust-cap band 69 frangibly connected to a lower end of the dust cap and operably engages cooperating tamper-evidencing structure on the base cap. In operation and use, closure 30*a* is used is substantially the same manner as closure 30 discussed above.

For convenience in explanation and accurate definition in the appended claims, the terms "up" or "upper", "down" or "lower", "inside" and "outside" are used to describe features of the present invention with reference to the positions of such features as displayed in the figures.

In many respects the modifications of the various figures resemble those of preceding modifications and the same reference numerals followed by subscript such as "a" or "b" or "c" designates corresponding parts.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed:

1. A closure for a container having an opening, said closure comprising:

a base cap including a cylindrical structure having an annular groove, an overcap having a locking structure rotatably received within said groove to axially fix said overcap with respect to said base cap, said base cap including an outer skirt having container-engaging structure, a cylindrical well defining a chamber for containing and supporting a consumable or other item located therein, a frangible membrane connected to said well along an inclined line of weakness and by a hinge member within said well, said hinge member having a pocket extending downward adjacent lower and upper terminuses of said line of weakness, said base cap cylindrical structure having an upwardly inwardly directed projection at an upper surface thereof defining a minimum diameter, said overcap including a body having gripping structure, an inner skirt received within and rotatably positioned relative to said well, and a cutting member depending from a lower end of said inner skirt substantially received within said pocket such that said cutting member extends below said lower terminus when said base cap is assembled to said overcap, whereby said cutting member severs said line of weakness upon substantial rotation of said overcap with respect to said base cap, said overcap inner skirt having an upper and lower portion, said upper portion being thickened to have an increased outside diameter as compared to said lower portion, and said increased outer diameter forming a seal with said minimum diameter of said cylindrical structure projection against penetration into said well.

2. A closure according to claim 1, wherein said cutting member includes an angled knife edge.

3. A closure according to claim 1, wherein said container-engaging structure includes container-engaging thread dimensioned and configured to cooperate with closure-engaging thread of the container.

4. A closure according to claim 1, further comprising a tamper-evidencing base band frangibly connected to a lower end of said outer base cap skirt.

5. A closure according to claim 1, further comprising a tamper-evidencing overcap band frangibly connected to a lower end of said overcap body and operably engaging tamper-evidencing structure on said base cap.

6. A closure according to claim 5, wherein said overcap band includes a inwardly-extending protrusion extending inwardly and operably engaging an outwardly-extending protrusion on said base cap.

7. A closure according to claim 6, wherein a first amount of relative rotation between said overcap and said base cap is required to at least partially separate said overcap band from said overcap body and a second amount of relative rotation is required for said cutting member to at least partially sever said line of weakness, said second amount being greater than said first amount.

8. A closure according to claim 6, wherein a first amount of relative rotation between said overcap and said base cap is required to at least partially separate said overcap band from said overcap body and a second amount of relative rotation is required for said cutting member to at least partially sever said line of weakness, said second amount being greater than said first amount.

9. A closure according to claim 5, wherein said overcap band includes a inwardly-extending protrusion extending inwardly and operably engaging an outwardly-extending protrusion on said base cap.

10. A closure according to claim 6, wherein a first amount of relative rotation between said overcap and said base cap is required to at least partially separate said overcap band from said overcap body and a second amount of relative rotation is required for said cutting member to at least partially sever said line of weakness, said second amount being greater than said first amount.

11. A closure according to claim 5, wherein said overcap band includes a inwardly-extending protrusion extending inwardly and operably engaging an outwardly-extending protrusion on said base cap.

12. A closure according to claim 1, wherein said inner overcap skirt includes a sealing bead extending around said lower end of said inner overcap skirt, said sealing bead engaging an inner surface of said well to provide a seal between said base cap and said overcap.

13. A closure according to claim 1, wherein said overcap further includes a pushing member having a lower end positioned adjacent said cutting member wherein said pushing member engages said membrane and pushes said membrane open upon substantial rotation of said overcap with respect to said cap base.

14. A closure according to claim 1, wherein said well and said inner overcap skirt form a sealed chamber, said chamber having a consumable or other item located therein.

15. A closure according to claim 1, wherein said overcap includes an aperture and said closure further comprises a dust cap including a plug for sealing said aperture.

16. A closure according to claim 15 wherein said dust cap includes a tamper-evidencing dust cap band frangibly connected to a lower end of said dust cap and operably engaging tamper-evidencing structure on said base cap.

17. A closure for a container having an opening, said closure comprising:

a base cap having an annular groove, an overcap having a locking structure rotatably received within said groove to axially fix said overcap with respect to said base cap, said base cap including an outer skirt having container-engaging structure, a cylindrical well defining a chamber for containing and supporting a consumable or other item located therein, a frangible membrane connected to said well along an inclined line of weakness and by a hinge member within said well, said hinge member having a pocket extending downward adjacent lower and upper terminuses of said line of weakness, and a cam structure, said overcap including a body having gripping structure, an inner skirt received within and rotatably positioned relative to said well, a cutting member depending from a lower end of said inner skirt substantially received within said pocket such that said cutting member extends below said lower terminus when said base cap is assembled to said overcap, and a pushing member whereby, upon substantial rotation of said overcap with respect to said base cap, said cutting member severs said line of weakness and movement of said pushing member in cooperation with said cam structure increases deflection of said membrane upon said severance.

18. A closure according to claim 17 wherein said cam structure is formed of a projection joined to said membrane adjacent said pocket, said projection extending upwardly in an axial direction between the lower and upper terminuses of said line of weakness.

19. A closure according to claim 18 wherein said cam structure further comprises a ramp portion connected to a wall portion.

20. A closure according to claim 19 wherein said cam structure ramp portion includes a free edge which extends upwardly at an angle to horizontal which is greater than that defined by the inclination of said line of weakness.

21. A closure according to claim 20 wherein said pushing member includes a lower end that contacts said free edge during said rotation.

22. A closure according to claim 21 wherein said lower end upon completion of rotation further contacts said wall portion and holds said membrane in a position of satisfactory deflection.

23. A closure according to claim 17, wherein said cutting member includes an angled knife edge.

24. A closure according to claim 17, wherein said container-engaging structure includes container-engaging thread dimensioned and configured to cooperate with closure-engaging thread of the container.

25. A closure according to claim 17, further comprising a tamper-evidencing base band frangibly connected to a lower end of said outer base cap skirt.

26. A closure according to claim 17, further comprising a tamper-evidencing overcap band frangibly connected to a lower end of said overcap body and operably engaging tamper-evidencing structure on said base cap.

27. A closure according to claim 17, wherein said inner overcap skirt includes a sealing bead extending around said lower end of said inner overcap skirt, said sealing bead engaging an inner surface of said well to provide a seal between said base cap and said overcap.

28. A closure according to claim 17, wherein said overcap further includes a pushing member having a lower end positioned adjacent said cutting member wherein said pushing member engages said membrane and pushes said membrane open upon substantial rotation of said overcap with respect to said cap base.

29. A closure according to claim 17, wherein said well and said inner overcap skirt form a sealed chamber, said chamber having a consumable or other item located therein.

30. A closure according to claim 17, wherein said overcap includes an aperture and said closure further comprises a dust cap including a plug for sealing said aperture.

31. A closure according to claim 30 wherein said dust cap includes a tamper-evidencing dust cap band frangibly connected to a lower end of said dust cap and operably engaging tamper-evidencing structure on said base cap.

32. A closure for a container having an opening, said closure comprising:

a base cap having an annular groove, an overcap having a locking structure rotatably received within said groove to axially fix said overcap with respect to said base cap, said base cap including an outer skirt having container-engaging structure, a cylindrical well defining a chamber for containing and supporting a consumable or other item located therein, a frangible membrane connected to said well along an inclined line of weakness and by a hinge member within said well, said hinge member having a pocket extending downward adjacent lower and upper terminuses of said line of weakness, said pocket having a stop therein said overcap including a body having gripping structure, an inner skirt received within and rotatably positioned relative to said well, and a cutting member depending from a lower end of said inner skirt substantially received within said pocket such that said cutting member extends below said lower terminus when said base cap is assembled to said overcap, whereby, upon complete rotation of said overcap with respect to said base cap, said cutting member severs said line of weakness and abuts said stop.

33. A closure according to claim 32 wherein said stop is comprised of a rib projecting upwardly from a bottom surface of said pocket.

34. A closure according to claim 33 wherein said rib is positioned approximately midway of an arcuate extent of said pocket.

35. A closure according to claim 34 wherein said cutting member resides at a region of said pocket to one side of said rib when initially assembled and before said rotation, and, upon completion of said rotation, resides at a position abutting the opposite side of said rib.

36. A closure according to claim 32, wherein said cutting member includes an angled knife edge.

37. A closure according to claim 32, wherein said container-engaging structure includes container-engaging thread dimensioned and configured to cooperate with closure-engaging thread of the container.

38. A closure according to claim 32, further comprising a tamper-evidencing base band frangibly connected to a lower end of said outer base cap skirt.

39. A closure according to claim 32, further comprising a tamper-evidencing overcap band frangibly connected to a lower end of said overcap body and operably engaging tamper-evidencing structure on said base cap.

40. A closure according to claim 32, wherein said inner overcap skirt includes a sealing bead extending around said lower end of said inner overcap skirt, said sealing bead engaging an inner surface of said well to provide a seal between said base cap and said overcap.

41. A closure according to claim 32, wherein said overcap further includes a pushing member having a lower end positioned adjacent said cutting member wherein said pushing member engages said membrane and pushes said membrane open upon substantial rotation of said overcap with respect to said cap base.

42. A closure according to claim 32, wherein said well and said inner overcap skirt form a sealed chamber, said chamber having a consumable or other item located therein.

43. A closure according to claim 32, wherein said overcap includes an aperture and said closure further comprises a dust cap including a plug for sealing said aperture.

44. A closure according to claim 43 wherein said dust cap includes a tamper-evidencing dust cap band frangibly connected to a lower end of said dust cap and operably engaging tamper-evidencing structure on said base cap.

* * * * *